US005323089A

United States Patent [19]

Bönigk

[11] Patent Number: 5,323,089

[45] Date of Patent: Jun. 21, 1994

[54] METHOD FOR THE PULSED MODE OF OPERATION OF HIGH-PRESSURE DISCHARGE LAMPS

[75] Inventor: Michael Bönigk, Berlin, Fed. Rep. of Germany

[73] Assignee: NARVA Berliner Gluehlampenwerk GmbH, Berlin, Fed. Rep. of Germany

[21] Appl. No.: 661,582

[22] Filed: Feb. 26, 1991

[30] Foreign Application Priority Data

Mar. 16, 1990 [DD] German Democratic Rep. ..... 3388243

[51] Int. Cl.[5] ..... H05B 41/16

[52] U.S. Cl. ..... 315/246; 315/175

[58] Field of Search ..... 315/246, 271, DIG. 7, 315/174, 175, 176

[56] References Cited

U.S. PATENT DOCUMENTS 4,412,155 10/1983 Isaka ..... 315/246
4,652,797 3/1987 Nilssen ..... 315/246
4,963,796 10/1990 Gottschling ..... 315/246

FOREIGN PATENT DOCUMENTS 2657824 7/1977 Fed. Rep. of Germany .
2825532 12/1978 Fed. Rep. of Germany .
3122183 12/1982 Fed. Rep. of Germany .
3636901 5/1988 Fed. Rep. of Germany .
0660306 4/1979 U.S.S.R. ..... 315/246

*Primary Examiner*—Eugene R. LaRoche
*Assistant Examiner*—A. Zarabian
*Attorney, Agent, or Firm*—Jordan and Hamburg

[57] ABSTRACT

In a method for operating high-pressure discharge lamps in a pulsed mode to improve the light properties thereof, gating pulses for the high-pressure discharge lamp are in the form of pulse groups of bipolar individual pulses with a pulse width of less than 100 μs. The repetition frequency of the pulse groups is higher than 100 Hz at a duty cycle of less than 0.8 and the individual pulses have a frequency of more than 400 Hz at an arbitrary duty cycle. A sinusoidal keep alive current or direct current is applied to the lamp between the pulse groups. The individual pulses can be spike pulses.

4 Claims, No Drawings

METHOD FOR THE PULSED MODE OF OPERATION OF HIGH-PRESSURE DISCHARGE LAMPS

FIELD OF THE INVENTION

The invention relates to a method for operating high-pressure discharge lamps in a pulsed mode to improve the light properties of the lamps.

BACKGROUND OF THE INVENTION

It has been known for some time that the light parameters of discharge lamps can be improved significantly by supplying them with energy in a pulsed form. These methods have attracted particular attention in the gating of high-pressure sodium vapor lamps, for raising the color temperature of the lamps from about 2,000° K. to more than 3,000° K. At the same time, an improvement in the color reproduction is possible. German Patents 2,657,824 and 2,825,532 disclose this technique.

When operating sodium vapor discharge lamps which contain several metal vapors and use bipolar pulses, demixing phenomena are to be avoided.

Then nature of the gating pulses, their shape, pulse width, duty cycle, rise and height have a decisive influence on the light parameters to be attained. Preferably, relatively broad pulses (about 100 to 200 μs) and duty cycles of about 0.2 are generally used, the repetition frequencies being less than 500 Hz, as described in the German Patent 3,636,901.

At frequencies above 500 Hz, the discharge system tends to produce resonance phenomena, which become evident in the form of severe arc instabilities and light yield losses (German Patent 3,122,183). It is also known to change the pulse geometry and the pulse shaping in such a way, when using electronic stabilizers, that the pulses have a rapid transition from the cooling domain into the state of a specified pulse output, an extended reaction time at this level and a rapid return to the state of the cooling phase. For the pulse shaping, a multisectional delay line, network, consisting of capacitative and inductive components, has been suggested. As is known from investigations, the optimum pulse width for sodium vapor discharge lamps lies between 100 μs and 200 μs, so that an appropriate electronic stabilizer would be a very expensive and bulky component when delay lines are used for shaping pulses.

The, generation of relatively wide pulses of appropriate height places high demands on the stabilizer technology, requiring large amounts of energy to be stored and switched.

SUMMARY OF THE INVENTION

It is an object of the invention to provide a method for operating high-pressure discharge lamps in a pulsed mode with which good light parameters are attained and which requires little in the way of expenditure for stabilizer technology.

SUMMARY OF THE INVENTION

The invention is directed to the provision of a method for operating high-pressure discharge lamps in a pulsed mode in particular in the jogging mode.

Pursuant to the invention, this objective is accomplished by forming the gating pulses for the high-pressure discharge lamp in pulse groups of bipolar individual pulses with a pulse width of less than 100 μs. The repetition frequency of the pulse groups is greater than 100 Hz at a duty cycle of less than 0.8, and the individual pulses have a frequency of more than 400 Hz at an arbitrary pulse-width repetition ratio. A sinusoidal keep alive current or direct current is fed to the lamp between the pulse groups. The individual pulses can also be spike pulses.

Surprisingly, it was observed in investigations of high-pressure sodium vapor lamps that the plasma is also able to follow very narrow spike pulses, that is, that effective increases in the color temperature and the color reproduction are also possible with such, while the light yield losses are only very slight. Since the average power fed into the lamp depends essentially on the energy of the gate pulses and their frequency, a possible keep alive output being disregarded, the frequency must be increased considerably over that employed for operation with broad pulses. The resonance phenomena of the arc, which are stimulated in the kilohertz region by the gate pulses, represent a disadvantage of this mode of operation. It has been possible to suppress these resonance phenomena by arranging the individual pulses in pulse groups. The frequency of the individual pulses should be selected so that resonance frequency gaps are utilized or lie above the resonance band of the discharge system.

The average power fed to the lamp now depends essentially on the width of the pulse groups (number and energy of the individual pulses per unit time) and on the repetition frequency of the pulse groups.

Even at very high frequencies of the individual pulses, there is no detectable light yield loss compared to the jogging mode of operation with broad pulses. The light parameters, such as color temperature and color reproduction, also attain identical values.

DETAILED DISCLOSURE OF A PREFERRED EMBODIMENT OF THE INVENTION

The invention will now be described in greater detail below with reference to an example thereof. A high-pressure sodium vapor lamp, specially designed for the jogging mode of operation, was operated with bipolar, spike pulses, combined in pulse groups. A sinusoidal current of 80 mA with a frequency of 20 kHz was used as a keep alive current. The pulse frequency of the individual gate pulses was 3 kHz the pulse group frequency was 150 Hz and the pulse group width was 1.2 ms.

The spike pulses were produced by charging and discharging capacitors. No resonance phenomena occurred at a gate pulse frequency of 3 kHz. The pulse height was selected so that an average color temperature of about 3,000° K. was obtained. At a peak pulse strength of I=20 A and a nominal power output of P=70 W, a light yield of 65 lm/W was achieved at the color temperature of Tc=3081° K. and the color reproduction of R(a)=66.

We claim:

1. A method for the operation of high-pressure discharge lamps in a pulsed mode at nominal power output with a pulsatory supply current, comprising forming gating pulses for a high-pressure discharge lamp into pulse groups of bipolar individual pulses having a pulse width of less than 100 μs, the repetition frequency of the pulse groups being higher than 100 Hz at a duty cycle of less than 0.8 and the individual pulses having a frequency higher than 400 Hz at an arbitrary duty cycle, and applying said gating pulses to the discharge lamp.

2. The method of claim 1, comprising applying a sinusoidal keep alive current to the discharge lamp between the pulse groups.

3. The method of claim 1, comprising applying a direct current to the discharge lamp between the pulse groups.

4. The method of claim 1, wherein said step of applying comprises applying the individual pulses to the discharge lamp in the form of spike pulses.

* * * * *